United States Patent [19]

Payet

[11] 3,960,483

[45] June 1, 1976

[54] DURABLE PRESS PROCESS EMPLOYING ALKYL SULFONIC OR SULFURIC ACID

[75] Inventor: George Louis Payet, Cincinnati, Ohio

[73] Assignee: The Strike Corporation, Cincinnati, Ohio

[22] Filed: Nov. 18, 1974

[21] Appl. No.: 524,770

Related U.S. Application Data

[63] Continuation-in-part of Ser. No. 486,168, July 5, 1974.

[52] U.S. Cl. ..... 8/116.4; 8/115.6; 427/336; 427/439

[51] Int. Cl.[2] ..... B05D 3/04

[58] Field of Search ..... 117/143 A, 106 R, 155 L, 117/62.1, 62.2; 427/336, 439; 8/116.4, 115.6

[56] References Cited

UNITED STATES PATENTS

| | | | |
|---|---|---|---|
| 2,311,080 | 2/1943 | Pinkey | 8/124 |
| 2,870,041 | 1/1959 | Waddle et al. | 117/62.1 |
| 3,186,954 | 6/1965 | Hushebeck | 117/143 A |
| 3,837,799 | 9/1974 | Wilson et al. | 8/115.6 |

OTHER PUBLICATIONS

Reinhardt et al., *Methanesulfonic Acid as Catalyst in Durable-Press Treatments of Cotton*, In *Textile Research Journal*, Sept. (1973), p. 555.

*Primary Examiner*—Carman J. Seccuro
*Attorney, Agent, or Firm*—Bacon & Thomas

[57] ABSTRACT

Cellulosic fiber-containing fabrics are made wrinkle resistant by a durable press process which comprises impregnating the fabric with an aqueous solution containing an alkyl sulfonic acid or sulfuric acid, capable of catalyzing the cross-linking reaction between formaldehyde and cellulose, and then exposing the impregnated fabric, while the fabric has a moisture content of over 20% by weight where the cellulose fibers are substantially completely swollen, to formaldehyde vapors and curing.

10 Claims, No Drawings

DURABLE PRESS PROCESS EMPLOYING ALKYL SULFONIC AR SULFURIC ACID

CROSS REFERENCE TO RELATED APPLICATION

This application is a continuation-in-part of my copending application Ser. No. 486,168, filed July 5, 1974 for a Durable Press Process.

BACKGROUND OF THE INVENTION

1. Field of the Invention

This invention relates to a durable press process for cellulosic fiber-containing fabrics and more particularly to a process which utilizes formaldehyde and a non-gaseous catalyst to impart wrinkle resistance to cellulosic fiber-containing fabrics.

There have been a great many proposed processes in recent years for treating cellulosic fiber-containing products, such as cloth made of cotton or cotton blends, with formaldehyde to provide durable cross-linking of the cellulose molecules and to thereby impart durable crease resistance and smooth drying characteristics to the goods. However, problems have been encountered, and although a number of the processes have been operated commercially there is a great need for improvement. One problem which recently has taken on critical importance is the quantity of chemicals and amount of energy used to obtain the desired degree of durable press in the fabric. These economic considerations tend to ensure the commercial success of any durable press process which utilizes smaller quantities of chemicals and energy to obtain fabrics having acceptable durable press finishes.

As pointed out in U.S. Pat. No. 3,706,526 granted Dec. 19, 1972, the known processes have tended to lack reproducibility, since control of the formaldehyde cross-linking reaction has been difficult. The process of this patent is said to solve the control problem by controlling moisture present in the cellulosic material during the reaction. The cellulosic material is conditioned to give it a moisture content of between about 4 to 20 percent, preferably 5 to 12 percent, based on the dry weight of the cellulose fiber, and it is then introduced into a gaseous atmosphere containing water vapor, a cellulose cross-linking amount of formaldehyde (e.g. 15 to 60 volume percent) and a catalytic amount of sulfur dioxide. However, the moisture control is difficult and the use of a toxic gas as the catalyst presents a safety factor as well as additional expense for environmental protection by requiring scrubbers and the like to eliminate the toxic substance from any effluent. Also, the presence of the gaseous catalyst and the steam result in corrosion of the curing chamber.

Canadian Pat. No. 897,363, granted Apr. 11, 1972, discloses a process for the formaldehyde cure of cellulosic fibers which comprises applying to the cellulosic material, a solution of zinc chloride, ammonium chloride, phosphoric acid or zinc nitrate, conditioning the fabric to a moisture content of between about 7 & 15 percent based on the dry weight of the fabric, and thereafter exposing the catalyst-containing fabric or article made therefrom to an atmosphere of formaldehyde or formaldehyde vapor (5 to 75 percent volume percent) at a temperature between about 90° and 150°C. The process requires precise moisture control and is said to be limited to the use of the few select catalysts.

It is also known to use methane sulfonic acid as a catalyst in the durable press treatment of cotton using relatively large quantities of a plastic type substance such as dimethylol methyl carbamate (DMMC) as the curing agent. Reinhart et al., "Durable-Press Treatments of Cotton" in Textile Research Journal, Vol. 43, No. 9., September 1973 indicates that methanesulfonic acid was found to function as a strong catalyst for durable-press finishing treatments with its behavior being similar to that of hydroxymethanesulfonic acid, except that it appears to be more stable. However, relatively large quantities 10 to 15 percent of the plastic like or "resin" material DMMC is required. Temperatures of about 250°F to about 320°F are indicated to give about the same results. Because of the large amounts of DMMC and the high temperatures required, this process cannot be considered a viable alternative to a formaldehyde vapor treating process using a low concentration of formaldehyde and low temperature.

Accordingly, a need exists for a simple and economical durable press process which does not depend on precise moisture control to moderate the cross-linking, does not require high concentrations of formaldehyde, high temperatures or utilize a noxious gaseous catalyst or other costly chemicals.

SUMMARY OF THE INVENTION

As set forth in my copending application Ser. No. 486,168, filed July 5, 1974, it has been observed that the cross-linking of cellulosic fibers with formaldehyde vapors takes place most readily when the fibers are in a moisture swollen condition. This is accomplished by introducing the fibers into a formaldehyde vapor treating chamber while they contain over 20 percent by weight of moisture, based on the dry weight of the fibers and, preferably, when over 60 percent by weight of moisture is present. Under these conditions it was found that the concentration of formaldehyde in the vapor treating chamber and amount of formaldehyde added can be kept to a minimum and the reaction controlled by impregnating the cellulosic material with that amount of a selected non-gaseous catalyst which will produce the desired amount of cross-linking under the curing conditions used. It has now been found that when the non-gaseous catalyst is sulfuric acid or an alkylsulfonic acid such as methanesulfonic acid, ethanesulfonic acid, or the like, still lower concentrations of formaldehyde may be used. Even more surprising is the fact that the reaction temperature is so much lower than with the catalyst described in my earlier filed application thereby rendering the present process of great commercial significance.

Thus, one object of this invention is to provide an improved formaldehyde vapor treating process in which the formaldehyde concentration in the vapor treating chamber can be kept at a low value, thereby reducing explosion and fire hazards, and significantly cost.

Another object of the invention is to provide a durable press process which enables the precise control of the catalyst present and avoids limitation upon the use of water as the moderator of the reaction.

Another object is to avoid having formaldehyde gas present in the curing chamber in the presence of a gaseous catalyst and moisture which results in the formation of low level polymers of formaldehyde which form encrustation on the apparatus used to carry out the process.

A final object of the invention is to provide a continuous pre-cure press process for producing wrinkle-free fabrics.

DETAILED DESCRIPTION OF THE INVENTION

As noted, the process of the invention comprises impregnating a cellulosic fiber-containing fabric with an aqueous solution containing a selected amount of sulfuric acid or an alkylsulfonic acid such as methanesulfonic acid, ethanesulfonic acid or the like, which is capable of catalyzing the cross-linking reaction between formaldehyde and cellulose, then contacting said impregnated fabric, while the fabric has a moisture content of above 20 percent by weight and the fibers are substantially completely swollen with formaldehyde vapors and curing to improve the wrinkle resistance of the fabric. The fabric which has been impregnated with catalyst is preferably immediately treated with formaldehyde vapors in this process.

The invention does not use limited amounts of moisture to control the cross-linking reaction since the cross-linking reaction is most efficient in the most highly swollen state of the cellulose fiber. The relatively high amount of water present allows more efficient conversion of formaldehyde to the hydrate which is the cross-linker. Thus, optimum results can be obtained with much less formaldehyde.

During the cross-linking reaction at the curing stage, moisture is given up from the fabric as the cross-linking occurs, resulting in a decrease in the moisture content of the fabric. In fabrics having a moisture content of 20 percent or less, this tends to lower the effectiveness of the cross-linking reaction requiring higher concentrations of formaldehyde. In the process of the present invention, moisture is given up from a high level, that is, greater than 20 percent, preferably greater than 30 percent, e.g. from 60 to 100 percent or more, and the cross-linking is optimized. Moisture which is so difficult to control, is not a problem in the present invention which only requires that the moisture content be above 20 percent which is simple to insure. Of course, water is not allowed to be present in so much of an excess as to cause the catalyst to migrate on the fabric.

The necessary moisture may be applied to the fabric by any conventional technique. It may be added separately or in the form of an aqueous solution of the catalyst, as by padding, fogging, spraying or the like. A fog spray will achieve high moisture content in a very short time. In addition, water spray or fog insures uniform moisturization.

In the present process, the amount of catalyst used controls the cross-linking. Since the catalyst may be applied to the fabric by the textile mill by established methods that produce uniform application, precise control of the catalyst is insured. Preferably, an aqueous solution of the catalyst is padded onto the fabric so as to supply both the catalyst and the moisture in one operation. Of course, a spray technique could also be used. Since the catalyst is not gaseous, it is not subject to diffusion rates, air currents, garment moisture in the chamber or steam concentration within the chamber, and is easier to control and handle.

The amount of catalyst may vary depending upon the particular type of fabric being treated and the desired characteristics of the final fabric. However, in general the catalyst is incorporated in the fabric, on a dry weight basis, in an amount within the range of from 0.1 to about 0.5 percent, preferably about 0.125 to 0.4 percent. It is to be appreciated that these amounts represent a significant reduction in the quantities of catalyst used in a formaldehyde vapor treatment process.

The catalyst may be applied to the fabric from an aqueous solution by conventional techniques, preferably such as padding or spraying. Preferably, the fabric is continuously precured by first applying the aqueous catalyst solution to the fabric, adding moisture if necessary, and then exposing the fabric to formaldehyde vapors, curing and then washing to remove any excess catalyst.

The concentration of the catalyst solution may be such as to supply with the catalyst the amount of water necessary to fully swell the cellulose fibers without further addition of moisture. Exposure to the formaldehyde vapors in this case is usually immediately after the catalyst is applied to the fabric. Only two process steps may be possible, application of catalyst solution, and treatment with formaldehyde vapors at the proper curing temperature. Of course, the fabric may be first formed into a garment and then impregnated with an aqueous solution of the acid catalyst followed by exposure to formaldehyde vapors.

The effect of catalyst concentration is demonstrated in the following example.

EXAMPLE 1

The following samples of 80 × 80 cotton print cloth were padded to 100 percent pick-up with aqueous solutions of methanesulfonic acid to provide the amount of catalyst as indicated in Table I. The samples were then sealed in a reactor having a volume of about 12 cubic feet at room temperature and exposed to formaldehyde vapors generated from paraformaldehyde over a 4 min. period. The temperature inside the reactor was then raised to 200°F and the sample removed. The sample was next washed and tumbled dried prior to testing. The crease resistance (Wrinkle Recovery) was determined by A.A.T.C.C.Test Method 66-1968 and the wash appearance (D.P. Wash) was determined in accordance with A.A.T.C.C.Test Method 124-1969 in which a rating of 5 is most satisfactory.

Table I

Methanesulfonic Acid Catalyzed Formaldehyde Cross-linked Samples

| Sample No. | Catalyst % | Cure Temp. Max.°F | C R A W | C R A F | C R A W + F | D.P. Rating |
|---|---|---|---|---|---|---|
| 1 | 0.5 | 200 | 160 | 159 | 319 | 5 |
| 2 | 0.4 | 200 | 159 | 161 | 320 | 5 |
| 3 | 0.3 | 200 | 159 | 160 | 319 | 5 |
| 4 | 0.2 | 200 | 162 | 161 | 323 | 5 |
| 5 | 0.175 | 200 | 154 | 155 | 309 | 3 |
| 6 | 0.150 | 200 | 152 | 146 | 298 | 2.8 |
| 7 | 0.125 | 200 | 149 | 148 | 297 | 2.5 |
| 8 | 0.100 | 200 | 133 | 130 | 263 | 2 |
| 9 | 0.075 | 200 | 107 | 113 | 220 | 1.5 |
| 10 | 0.050 | 200 | 103 | 110 | 213 | 1 |

As can be seen from Table I, good results are obtained when a catalyst concentration of 0.175 to 0.2 percent is employed. Obviously, a catalyst concentration greater than 0.2 percent will still effectively catalyze the system, however, degradation of the fabric may occur as the concentration of the catalyst increases. Also, concentrations as low as 0.125 percent will provide a substantial treatment, with some sacrifice of wash appearance. Thus, the range of concentration from 0.175 to 0.2 percent is preferred.

As indicated in my copending application Ser. No. 486,168, the high moisture content in the fabric fully swells the cellulose fibers and optimizes the cross-linking reaction thereby providing improved crease resistance. Accordingly, considerably less formaldehyde is required than in known vapor processes. By using sulfuric acid or an alkylsulfonic acid still further reductions in the combined concentration of formaldehyde vapor and catalyst may be obtained. By the process of the present invention utilizing methanesulfonic acid as the catalyst in concentrations of only 0.2 percent full treatment of the fabric is obtained using a formaldehyde concentration of 1.53 percent by volume. By full treatment, is meant crease recovery angles of 309° to 322°. Generally, the formaldehyde concentrations in the treatment chamber is from about 1.0 to about 6.5 percent by volume, preferably about 1.0 to 3.0 percent. The dry add-on by the reaction of the formaldehyde with the fabric at this concentration is generally less than about 0.5 percent. At concentrations of formaldehyde below about 1 percent by volume in the treatment chamber, the wash appearance and crease resistance become less satisfactory than desired. At concentrations of above about 3 percent there is usually no significant increase in these properties.

The process of the present invention enables one to obtain desirable durable press properties using a minimum quantity of formaldehyde and catalyst resulting in a direct reduction in the cost of the process.

The utilization of small concentrations of formaldehyde in the treating chamber also significantly reduces the fire hazard presented by formaldehyde since formaldehyde tends to be explosive in concentrations of 7 percent by volume or above when mixed with air.

The curing temperature at which the final cross-linking takes place is in the range of from about 175°F to about 212°F. Advantageously, it should be about 200°F to insure that there is sufficient cross-linking to provide the necessary wrinkle resistance in the fabric. Temperatures above about 225°F or higher as conventionally employed do not improve the present process and add to the overall cost of the process and may cause excessive degradation. The formaldehyde treatment and curing may take place in the same treating chamber or in separate chambers or zones of the treating apparatus.

It is sometimes desirable, depending upon the desired characteristic of the fabric, to add to the fabric a polymeric resinous additive that is capable of forming a soft film. For example, such additives may be a latex of fine aqueous dispersion of polyethylene, various alkyl acrylate polymers, acrylonitrile-butadiene copolymers, diacetylated ethylenevinyl acetate copolymers, polyurethanes and the like.

Such additives are well known to the art and generally commercially available in concentrated aqueous latex form. For use in the process of this invention, such a latex is diluted to provide about 1 to 3 percent polymer solids in the aqueous catalyst-containing padding bath before the fabric is treated therewith. However, it is not necessary or desirable to add monomers or formaldehyde binding agents.

The effect of curing temperature and catalyst concentration is demonstrated in the following example.

EXAMPLE 2

The following samples of 80 × 80 cotton print cloth were padded to 100 percent pick-up with aqueous solutions of methanesulfonic acid to provide the amount of catalyst as indicated in Table II. The samples were then sealed in the reactor at room temperature and exposed to formaldehyde vapors generated from paraformaldehyde over a 4 min. period to maximum concentration of 6 percent by volume. The fabric inside the reactor was then raised to the temperature indicated and then removed. In addition, and where indicated, a commercial softener manufactured by Proctor and Gamble under the trade name VIVA was used as a fabric softener.

Table II

| 100% Cotton | Cat. % | Max. Temp. °F. | | Viva % | CRA | | | DP |
|---|---|---|---|---|---|---|---|---|
| | | Metal | Glass | | W | F | W + F | |
| 1 | 1.0 | 80–100 | | -0- | 84.7 | 83.7 | 168.4 | 1 |
| 2 | 0.5 | 175 | 173 | -0- | 133.0 | 142.0 | 275.0 | 1 |
| 3 | 0.5 | 185 | 180 | -0- | 156.7 | 157.0 | 313.7 | 2 |
| 4 | 0.5 | 185 | 180 | -0- | 159.7 | 158.0 | 317.7 | 3 |
| 5 | 0.5 | 200 | 195 | -0- | 159.3 | 160.7 | 320.0 | 4–5 |
| 6 | 0.5 | 175 | 173 | 2.0 | 143.7 | 142.3 | 286.0 | 3 |
| 7 | 0.5 | 185 | 180 | 2.0 | 157.3 | 154.0 | 311.3 | 3 |
| 8 | 0.5 | 185 | 180 | 2.0 | 166.0 | 160.3 | 326.3 | 4 |
| 9 | 0.5 | 200 | 195 | 2.0 | 166.3 | 164.0 | 330.3 | 5 |

As can be seen from Table II, a temperature of about 100° is insufficient to obtain sufficient durable press even with a catalyst concentration of 1 percent. As also can be seen from Table II, a temperature of from about 175° to about 200°F provides sufficient reaction. The use of a fabric softener improves the DP of the fabric.

EXAMPLE 3

The same procedure was followed as in example 2 using different concentrations of catalyst and at different curing temperatures as indicated in Table III. The catalyst used was methanesulfonic acid and the tensil strength and tear strength were determined by conventional standard tests in the art.

Table III

| Sample No. | Cat. % | Cure 1/ Temp. (°F.) | CRA | | | Tensile Strength (lbs.) | % Retained | Tear Strength (lbs.) | % Retained | DP Wash Appear. |
|---|---|---|---|---|---|---|---|---|---|---|
| | | | W | F | W + F | | | | | |
| 1 | 0.5 | 175 | 114 | 120 | 234 | — | — | — | — | 2 |
| 2 | 0.5 | 185 | 155 | 153 | 308 | 10 | 27 | 0.73 | 46 | 4 |

Table III-continued

| Sample No. | Cat. % | Cure 1/ Temp. (°F.) | C R A W | C R A F | C R A W + F | Tensile Strength (lbs.) | % Retained | Tear Strength (lbs.) | % Retained | DP Wash Appear. |
|---|---|---|---|---|---|---|---|---|---|---|
| 3 | 0.5 | 200 | 160 | 159 | 319 | 7 | 19 | 0.34 | 22 | 4 |
| 4 | 0.4 | 175 | 93 | 102 | 195 | — | — | — | — | 3 |
| 5 | 0.4 | 185 | 152 | 149 | 301 | 12 | 32 | 0.40 | 25 | 5 |
| 6 | 0.4 | 200 | 159 | 161 | 320 | 6 | 16 | 0.37 | 23 | 5 |
| 7 | 0.3 | 175 | 92 | 96 | 188 | — | — | — | — | 2 |
| 8 | 0.3 | 185 | 139 | 141 | 280 | 12 | 32 | 0.53 | 34 | 4 |
| 9 | 0.3 | 200 | 159 | 160 | 319 | 9 | 24 | 0.40 | 25 | 5 |
| 10 | 0.2 | 175 | 135 | 136 | 271 | 15 | 41 | 0.80 | 53 | 4 |
| 11 | 0.2 | 185 | 150 | 149 | 299 | 12 | 32 | 0.52 | 33 | 4 |
| 12 | 0.2 | 200 | 162 | 161 | 323 | 8 | 22 | 0.47 | 30 | 5 |
| 13 | Control | — | 91 | 104 | 195 | 37 | — | 1.58 | — | 1 |

As can be seen from Table III, the strength of 100 percent cotton is somewhat reduced. However, the present invention is applicable not only to pure cotton fabrics but to blends with materials which add strength.

As the cellulosic fiber-containing fabric which may be treated by the present process there can be employed various natural or artificial cellulosic fibers and mixtures thereof, such as cotton, linen, hemp, jute, ramie, sisal, rayons, e.g., regenerated cellulose (both viscous and caprammonium). Other fibers which may be used in blends with one or more of the above-mentioned cellulosic fibers are, for example, polyamides (e.g., nylons), polyesters, acrylics (e.g., polyacrylonitrile), polyolefins, polyvinyl chloride, and polyvinylidene chloride. Such blends preferably include at least 35 to 40 percent by weight, and most preferably at least 50 to 60 percent by weight, of cotton or natural cellulose fibers.

The fabric may be a resinated material but preferably it is unresinated; it may be knit, woven, non-woven, or otherwise constructed. It may be flat, creased, pleated, hemmed, or shaped prior to contact with the formaldehyde containing atmosphere. After processing, the formed crease-proof fabric will maintain the desired configuration substantially for the life of the article. In addition, the article will have an excellent wash appearnace even after repeated washings.

EXAMPLE 4

The procedure of example 3 was followed except that polyester cotten blend fabrics were used and the results are shown in Table IV.

Table IV

Methanesulfonic Acid as a Catalyst in Vapor Phase Formaldehyde Cross-linking of Cotton Polyester Blends

| Polyester Cotton | Style | Cat. % | Max. Temp. °F Metal | Max. Temp. °F Glass | Viva % | C R A W | C R A F | C R A W + F | DP |
|---|---|---|---|---|---|---|---|---|---|
| 1 | 286 | 0.5 | 200 | 195 | 2.0 | 159.3 | 167.3 | 326.6 | 5 |
| 2 | 286 | 0.3 | 200 | 195 | 2.0 | 153.3 | 160.7 | 314.0 | 4–5 |
| 3 | T-9 | 0.5 | 200 | 195 | 2.0 | 166.3 | 162.7 | 329.0 | 5 |
| 4 | T-9 | 0.3 | 200 | 195 | 2.0 | 153.3 | 150.3 | 303.6 | 4–5 |
| 5 | 286 | — | — | — | — | 119.3 | 139.0 | 258.3 | — |
| 6 | T-9 | — | — | — | — | 125.7 | 128.0 | 253.7 | — |

NOTE:
Style 286 (Springs Mills) is a 65/35 Polyester Cotton Blend Fabric.
Style T-9 (Springs Mills) is a 50/50 Polyester Cotton Blend Fabric.

EXAMPLE 5

Various blend fabrics as listed in Table V were treated with a solution containing the listed amount of methanesulfonic acid, softener 2.0% (Viva) and 0.1% Triton X-100 Wetting Agent (Rohm & Haas).

The fabrics were padded to 100 percent pick-up and were then stretched smooth on a pin frame then sealed in the reactor. The listed amount of paraformaldehyde was then released and vaporized over a 4 min. period to saturate the fabric at room temperature, after which the air in the reactor was raised to 200°F and the sample removed. (In the case of Style 286, which is a heavier weight fabric, a final temperature of 210°F was employed).

All samples were washed and tumble dried prior to any physical testing, the results of which are shown in Table V.

Table V

Methanesulfonic Acid Catalyzed Formaldehyde Cross-linking on Various Blend Fabrics.

| Sample No. | Catalyst % | Para-formaldehyde (grams) | Form-aldehyde (Vol. %) | C R A W | C R A F | C R A W + F |
|---|---|---|---|---|---|---|
| Style 429 65/35 Polyester Cotton Batiste | | | | | | |
| 1 | 0.3 | 5 | 1.53 | 164 | 163 | 327 |
| 2 | 0.2 | 5 | 1.53 | 162 | 160 | 322 |
| Style 638 65/35 Polyester Cotton Sheeting | | | | | | |
| 3 | 0.3 | 5 | 1.53 | 159 | 160 | 319 |
| 4 | 0.2 | 5 | 1.53 | 160 | 163 | 323 |
| Style 286 65/35 Polyester Cotton Twill | | | | | | |
| 5 | 0.4 | 5 | 1.53 | 151 | 160 | 311 |
| 6 | 0.3 | 5 | 1.53 | 153 | 159 | 312 |
| 7 | 0.2 | 5 | 1.53 | 150 | 159 | 309 |
| 8 | 0.1 | 5 | 1.53 | 133 | 147 | 279 |
| 9 | 0.4 | 10 | 3.06 | 152 | 159 | 311 |
| 10 | 0.3 | 10 | 3.06 | 153 | 159 | 312 |
| 11 | 0.2 | 10 | 3.06 | 151 | 155 | 306 |
| 12 | 0.1 | 10 | 3.06 | 129 | 145 | 274 |
| 13 | 0.1 | 15 | 4.59 | 126 | 145 | 271 |
| Style T-9 50/50 Polyester Cotton Sheeting | | | | | | |
| 14 | 0.300 | 5 | 1.53 | 160 | 157 | 317 |
| 15 | 0.200 | 5 | 1.53 | 157 | 153 | 313 |
| 16 | 0.175 | 5 | 1.53 | 157 | 155 | 312 |
| 17 | 0.300 | 10 | 3.06 | 155 | 151 | 306 |
| 18 | 0.200 | 10 | 3.06 | 150 | 150 | 300 |
| 19 | 0.175 | 10 | 3.06 | 147 | 141 | 288 |

As is readily apparent from Table V full treatment can be obtained at low catalyst concentrations and low formaldehyde concentrations, e.g. 1.53 percent by volume.

EXAMPLE 6

The procedure of example 5 was followed using 20 grams of paraformaldehyde and the blend fabrics as indicated. The results are shown in Table VI. The final curing temperature was 200°F.

Table VI

Methanesulfonic Acid Catalyzed Formaldehyde Crosslinked Polyester/Cotton Blend Fabrics

| Sample No. | Blend Type | Catalyst % | C R A W | C R A F | C R A W + F | Tensile Strength Filling (lbs) | Tear Strength Filling (lbs) | Abrasion 1/ % Loss | Abrasion 1/ % Retained | D.P. Rating |
|---|---|---|---|---|---|---|---|---|---|---|
| 1 | 65/35 | 0.5 | 159 | 167 | 326 | 70 | 6.63 | 13.9 | 86.1 | 5 |
| 2 | 65/35 | 0.3 | 153 | 161 | 314 | 69 | 6.40 | 9.7 | 90.3 | 4.5 |
| 3 | 50/50 | 0.5 | 166 | 163 | 329 | 43 | 2.15 | 21.3 | 78.7 | 5 |
| 4 | 50/50 | 0.3 | 153 | 150 | 303 | 45 | 2.01 | 12.4 | 87.6 | 4.5 |
| 5 | 65/35 | Control | 119 | 139 | 258 | 63 | 6.54 | 4.1 | 95.9 | 2 |
| 6 | 50/50 | Control | 126 | 128 | 254 | 63 | 2.13 | 3.1 | 96.9 | 1.5 |

1/ Abrasion Run in the Accelerotor at 2500 RPM for 2 minutes.

Table VI clearly indicates that optimum physical properties are obtained using blend fabrics and low catalyst concentration.

Quite unexpectedly it has been surprisingly found that sulfuric acid also effectively catalyzes the formaldehyde cross-linking reaction of cellulose to provide a high degree of wrinkle resistance without excessive degradation or discoloration as would have been expected from the use of sulfuric acid. Apparently, the low concentration of sulfuric acid (i.e. from 0.1 to 0.4 percent) and the low temperature requirements reduce fabric degradation on cellulose normally encountered when sulfuric acid is used to catalyze formaldehyde cross-linking at higher temperatures or to catalyze conventional resin systems. This is demonstrated in the following example.

EXAMPLE 7

Samples of a 80 × 80 cotton print cloth which were padded to 100 percent pickup with an aqueous solution containing the listed sulfuric acid concentration, 2% Viva (softener) and 0.1% Triton X-100 (wetting agent). The fabric was then exposed to 10 grams of paraformaldehyde (3.06 percent by volume), vaporized over a 4 min. period then heated to 200°F. and then washed and tumble dried.

Table VII

| Sample No. | Sulfuric Acid % | Viva % | C R A W | C R A F | C R A W + F | D.P. Rating |
|---|---|---|---|---|---|---|
| 1 | 0.2 | 2.0 | 159 | 161 | 320 | 4.5 |
| 2 | 0.2 | 2.0 | 162 | 160 | 322 | 4.5 |
| 3 | 0.4 | 2.0 | 165 | 164 | 329 | 5.0 |

These results clearly show that sulfuric acid is as active as methanesulfonic acid in catalyzing the reaction. The process is well catalyzed by the acid.

The equipment necessary to carry out the process is very much simplified since moisture control is not used as the moderator for the reaction. The aqueous, acid catalyst may be applied by padding or spraying. Moisturization of the fabric, if additional moisture is necessary, may be carried out by passing the fabric through a fog of water before entering the reaction chamber. The fabric containing the latent catalyst may then be placed in a reaction chamber to which gaseous formaldehyde is supplied from any convenient source, e.g., a formaldehyde generator wherein formaldehyde vapor is produced by heating paraformaldehyde. The formaldehyde vapors are diluted with air or other gas to provide the desired concentration. Preferably, the formaldehyde is generated outside the chamber containing the fabric to reduce the fire hazard.

The reaction chamber is preferably one which can be heated to a sufficiently high temperature to insure that the cross-linking reaction takes place. The atmosphere in the reaction chamber is preferably a mixture containing from 1 to 3.0 percent formaldehyde gas by volume, diluted with air or an inert gas such as nitrogen. Higher concentrations of formaldehyde could be used but are not required by this process.

All results reported in the foregoing specification were obtained by the following standard methods:

1. D.P. Wash — A.A.T.C.C. Test Method 124—1969.
2. Abrasion — Accelerotor Method A.A.T.C.C. Test Method 93—1970 Wt. Loss.
3. Crease Resistance (Wrinkle Recovery) — Recovery Method A.A.T.C.C. Test Method 66—1968.
4. Tensile Strength — A.S.T.M.D-1682—64 (Test 1C)

Having now fully described the invention, it will be apparent to one of ordinary skill in the art that many changes and modifications can be made thereto without departing from the spirit or scope of the invention as set forth herein.

I claim:

1. A durable-press process for cellulosic fiber-containing fabrics, comprising: impregnating a cellulosic fiber-containing fabric with an aqueous solution of an alkylsulfonic acid or a low concentration of sulfuric acid which is capable of catalyzing the cross-linking reaction between formaldehyde and cellulose, to provide from 0.1 to about 0.5 percent of said catalyst in said fabric on a dry weight basis, then exposing said impregnated fabric, while said fabric has a moisture content of above 20 percent by weight where the cellulose fibers are substantially completely swollen, to formaldehyde vapors and curing under conditions at which formaldehyde reacts with cellulose in the presence of the catalyst to improve the wrinkle resistance of the fabric.

2. The process of claim 1, wherein the catalyst is methane-sulfonic acid.

3. The process of claim 1, wherein the catalyst is sulfuric acid.

4. The process of claim 1, wherein the moisture content of the fabric at the time of exposure to formaldehyde is above about 30 percent by weight.

5. The process of claim 1, wherein the fabric is cotton.

6. The process of claim 1, wherein the fabric is a cotton-polyester blend.

7. The process of claim 2, wherein the catalyst concentration is in the range of about 0.125 to 0.2 percent and the temperature during the cross-linking reaction is below about 212°F.

8. The process of claim 1, wherein the fabric is exposed to an atmosphere containing from about 1.0 to 3.0 percent by volume of formaldehyde.

9. The process of claim 3, wherein the concentration of sulfuric acid is from 0.1 to 0.4 percent.

10. A durable-press process for cellulosic fiber containing fabrics, comprising: impregnating a cellulosic fiber-containing fabric with an aqueous solution containing from about 0.1 to 0.5 percent by weight of sulfuric acid or methanesulfonic acid and at least about 60 percent by weight of water in said fabric, based on the dry weight of the fabric, then exposing said fabric while containing said amount of water to formaldehyde vapors and curing at a temperature of about 175°F to 212°F to cause cross-linking between the cellulose and formaldehyde while the fibers are in a swollen condition to thereby improve the wrinkle resistance of the fabric.

* * * * *